US009533811B2

(12) United States Patent
Ludwig

(10) Patent No.: US 9,533,811 B2
(45) Date of Patent: Jan. 3, 2017

(54) CONTAINER CARRIER

(71) Applicant: ILLINOIS TOOL WORKS INC., Glenview, IL (US)

(72) Inventor: Christopher Ludwig, Buffalo Grove, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/195,633

(22) Filed: Jun. 28, 2016

(65) Prior Publication Data

US 2016/0304258 A1 Oct. 20, 2016

Related U.S. Application Data

(63) Continuation of application No. 13/835,311, filed on Mar. 15, 2013, now Pat. No. 9,376,245.

(60) Provisional application No. 61/693,664, filed on Aug. 27, 2012.

(51) Int. Cl.

| | |
|---|---|
| ***B65D 75/00*** | (2006.01) |
| ***B65D 71/50*** | (2006.01) |
| ***B65D 81/36*** | (2006.01) |

(52) U.S. Cl.

CPC ..... *B65D 71/504* (2013.01); *B65D 81/361* (2013.01); *B65D 2203/00* (2013.01)

(58) Field of Classification Search

CPC ..... B65D 71/504; B65D 71/506; B65D 71/50; B65D 2203/00

USPC ..... 206/141, 147, 150, 151, 162, 163, 199,206/427, 428, 459.5; 294/87.2

See application file for complete search history.

(56) References Cited

U.S. PATENT DOCUMENTS

| | | | | | |
|---|---|---|---|---|---|
| 4,941,573 | A * | 7/1990 | Fuerstman | G09F 3/00 | 206/150 |
| 5,651,453 | A * | 7/1997 | Olsen | B65D 71/504 | 206/150 |
| 6,145,656 | A * | 11/2000 | Marco | B65D 71/08 | 206/147 |
| 6,170,652 | B1 * | 1/2001 | Olsen | B65D 71/504 | 206/150 |
| 6,230,880 | B1 * | 5/2001 | Marco | B65D 71/504 | 206/150 |
| 7,445,114 | B2 * | 11/2008 | Olsen | B65D 71/504 | 206/150 |
| 2003/0080004 | A1 * | 5/2003 | Olsen | B65D 71/504 | 206/150 |
| 2008/0230405 | A1 * | 9/2008 | Olsen | B65D 71/504 | 206/150 |
| 2013/0037435 | A1 * | 2/2013 | St-Laurent | B65D 71/36 | 206/427 |
| 2013/0292272 | A1 * | 11/2013 | Waldo, II | B65D 71/504 | 206/147 |

* cited by examiner

*Primary Examiner* — Luan K Bui

(74) *Attorney, Agent, or Firm* — Pauley Erickson & Kottis

(57) ABSTRACT

This invention relates to a package of a plurality of containers unitized with a flexible carrier. The carrier is constructed from a plastic planar sheet having a plurality of container receiving apertures and a panel positioned with respect to the planar sheet. The panel is preferably cut to form a removable and assemblable functional or decorative object, such as a model or glasses.

14 Claims, 9 Drawing Sheets

CONTAINER CARRIER

CROSS REFERENCE TO RELATED APPLICATION

This application is a continuation-in-part of U.S. patent application Ser. No. 13/835,311, filed Mar. 15, 2013, U.S. Pat. No. 9,376,245, which claims the benefit of U.S. Provisional Application No. 61/693,664, filed Aug. 27, 2012. The co-pending Patent Application is hereby incorporated by reference herein in its entirety and is made a part hereof, including but not limited to those portions which specifically appear hereinafter.

BACKGROUND OF THE INVENTION

Field of the Invention

This invention relates to a container carrier or unitizing a desired quantity of containers.

Description of Prior Art

Container carriers connect two or more containers into a sturdy unitized package or "multipack" of containers. Carriers are generally planar arrays of rings, sometimes referred to as "six-pack carriers," typically formed from a thermoplastic sheet material. Carriers are applied to containers of various sizes and shapes.

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, when used alone has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and the promotional properties of a box carrier.

This invention relates to a carrier, for unitizing a plurality of containers, having a plurality of container receiving apertures configured with an integral panel and/or handle that includes a removable and assemblable novelty.

SUMMARY OF THE INVENTION

A container carrier according to this invention carries a plurality of containers such as cans or bottles. The carrier comprises a planar, preferably plastic, sheet formed with a plurality of container receiving apertures. The container receiving apertures are formed in longitudinal rows and transverse ranks.

A panel is preferably integrally formed with the sheet so that the panel extends outward from a panel edge of the sheet. The panel is preferably shaped to convey at least one of a product name, a product property, a promotional shape, a trademark, a tradename, alpha-numeric characters, symbols and/or a fanciful design intended to draw attention to the product. In addition, a perforation or similar line of weakness is preferably positioned along the panel to permit removal of two or more sub-elements of the panel for assembly and reuse.

The containers are positioned in each container receiving aperture to form a package having a panel and/or a handle that is prominent with respect to the package and visible to a consumer such that its stylized form projects the intended image of the product. Such a configuration of the panel and/or handle results in a package of containers having a prominent display area or "billboard" for advertising, information, graphics and other marketing material and further with some "value-added" giveaway for the consumer to remove, assemble and reuse. Such giveaways may include glasses, models, puzzles, wristbands, bookmarks, ornaments, and/or similar decorative and/or functional objects.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
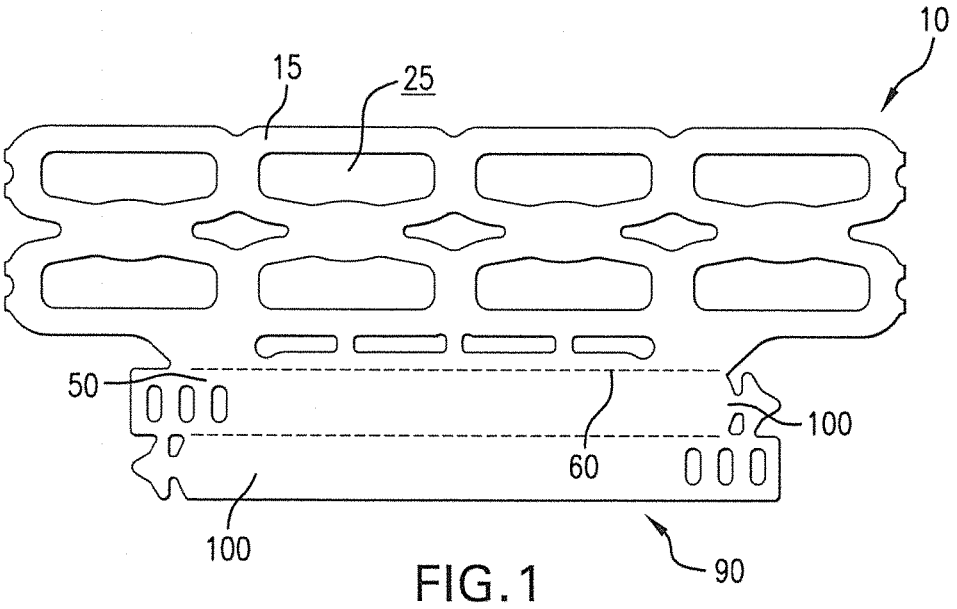
FIG. 1 is a side elevational view of a flexible carrier according to one preferred embodiment of this invention.
Figure 2:
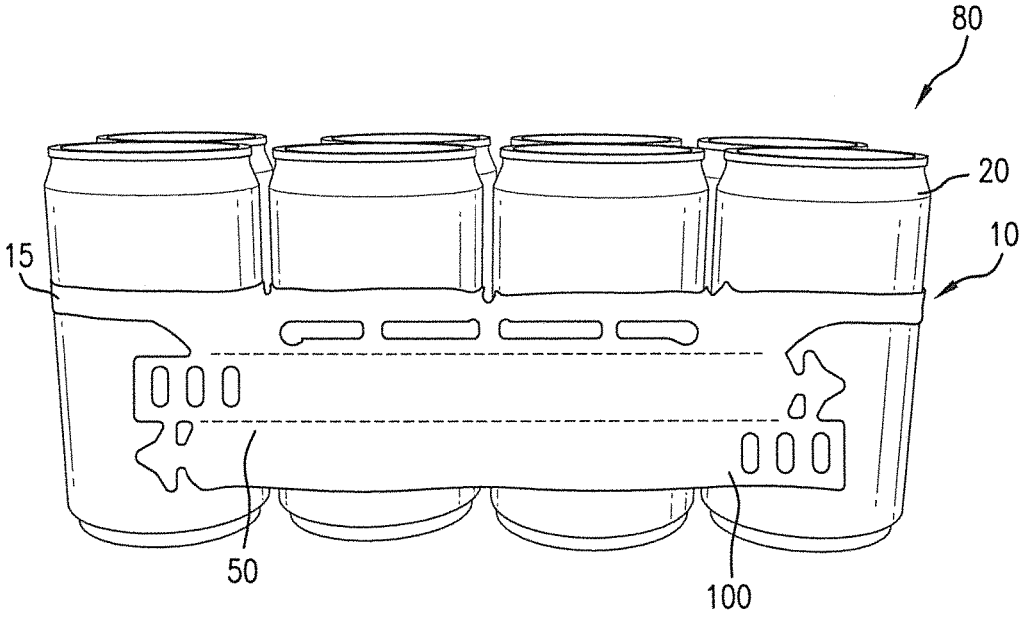
FIG. 2 is a front view of a package of containers using the carrier shown in FIG. 1.
Figure 3:
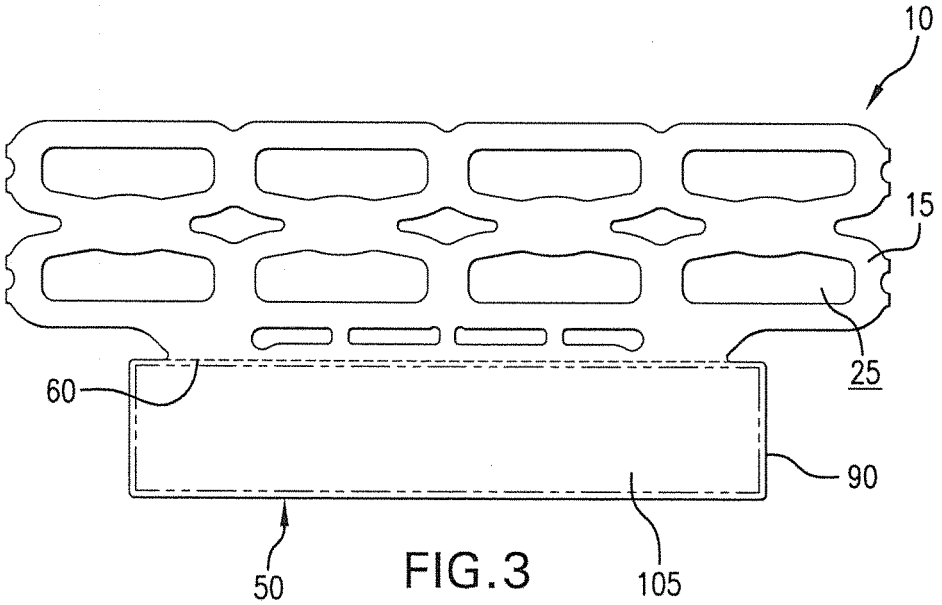
FIG. 3 is a side elevational view of a flexible carrier according to one preferred embodiment of this invention.
Figure 4:
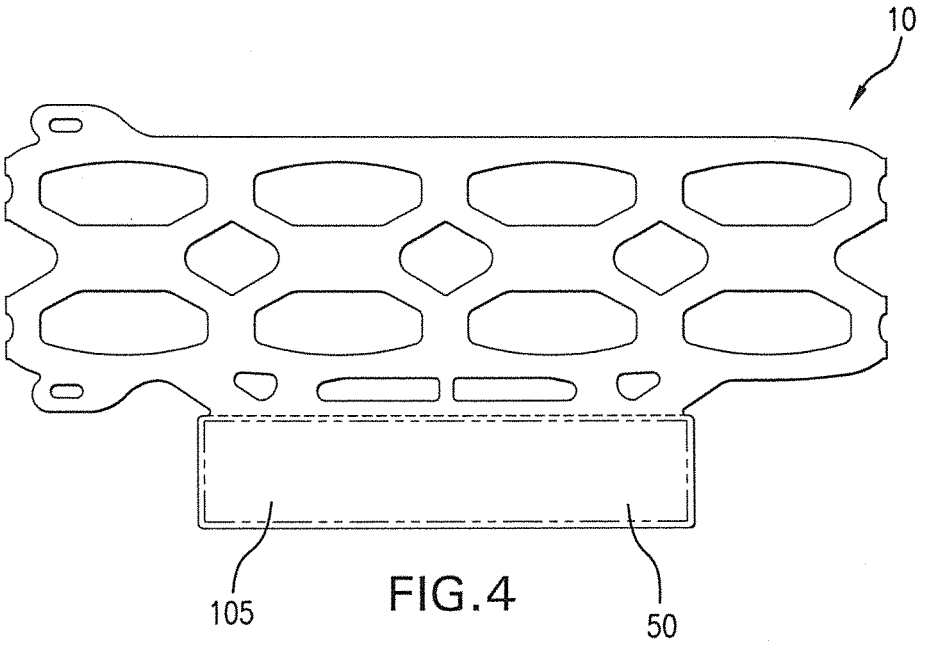
FIG. 4 is a side elevational view of a flexible carrier according to one preferred embodiment of this invention.
Figure 5:
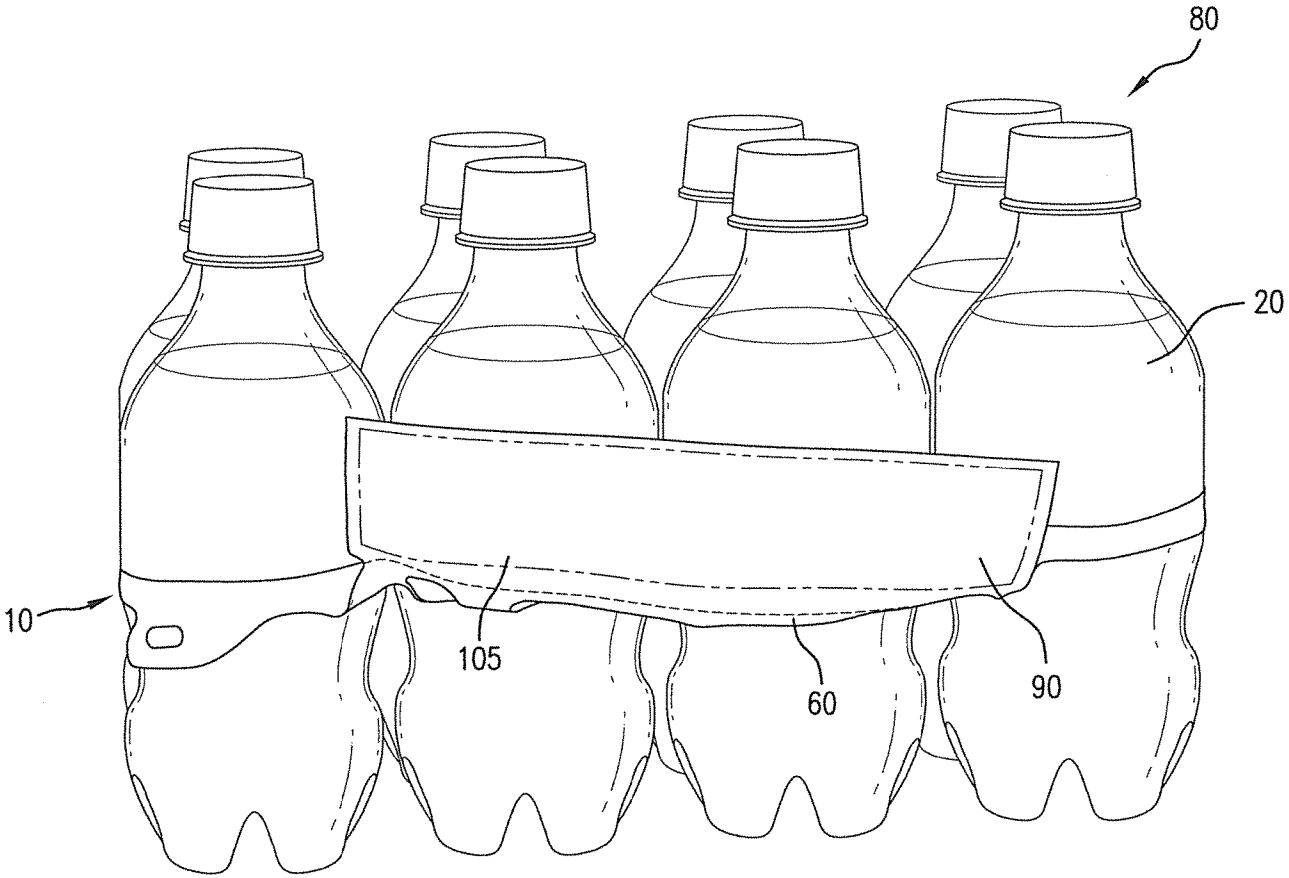
FIG. 5 is a front view of a package of containers using the carrier shown in FIG. 4.

FIGS. 1-8 show carriers 10 and packages 80 according to various preferred embodiments of this invention. Containers 20 shown in FIGS. 2 and 5 are preferably cans or bottles. Although cans are shown in FIGS. 2 and 5, bottles or any other commonly unitized container 20 may be used with carrier 10 according to this invention. Containers 20 are preferably like-sized within a single carrier 10 to form package 80.

Carrier 10 unitizes a plurality of containers 20 to create package 80, such as package 80 shown in FIGS. 2, 5, 6 and 8. Carrier 10 comprises planar sheet 15 preferably constructed from a flexible, resilient material such as plastic. In one preferred embodiment of this invention, sheet 15 is made from low density polyethylene.

Sheet 15 of material is preferably cut, using means known to those skilled in the art, such as a stamping die, to form a plurality of container receiving apertures 25 in sheet 15. Preferably, six or more container receiving apertures 25 are formed in sheet 15 in longitudinal rows and transverse ranks. Preferably, container receiving apertures 25 are configured in two rows of three ranks or in two rows of four ranks. Sheet 15 may include other configurations of container receiving apertures 25 depending on the size of package 80 desired.

In one preferred embodiment of this invention, panel 50 is integrally formed with sheet 15. Panel 50 preferably has an overall longitudinal panel length less than an overall length of sheet 15. Panel 50 preferably accommodates, on one or both sides, UPC and proof of purchase labels, graphics, and promotional and/or other information related to contents and/or ingredients of package 80.

Panel 50 preferably extends outward from a longitudinal edge of sheet 15. As shown in FIGS. 1-6 and 8, panel 50 is at least partially formed along a portion of at least one row of container receiving aperture 25.

Figure 6:
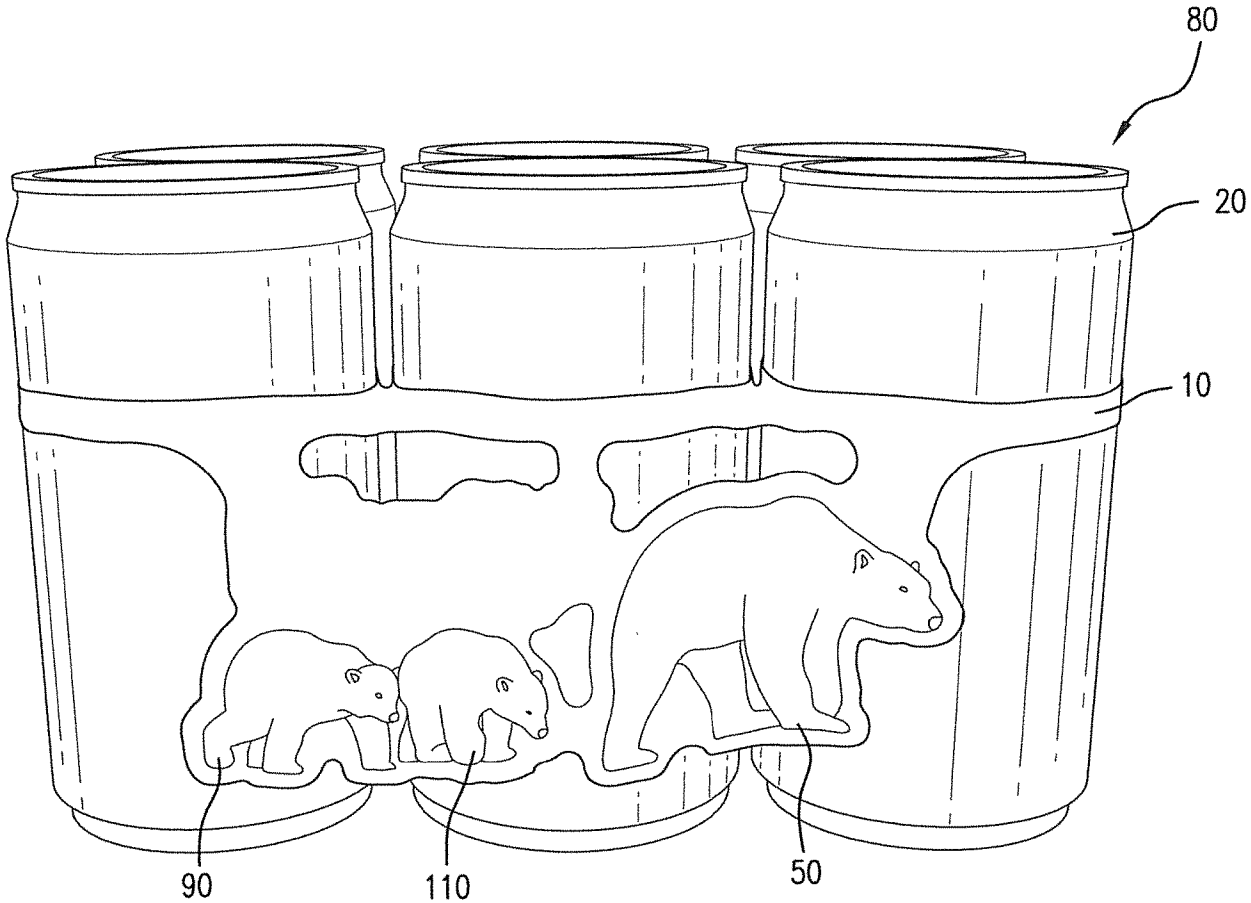
FIG. 6 is front view of a package of containers according to one preferred embodiment of this invention.
Figure 7:
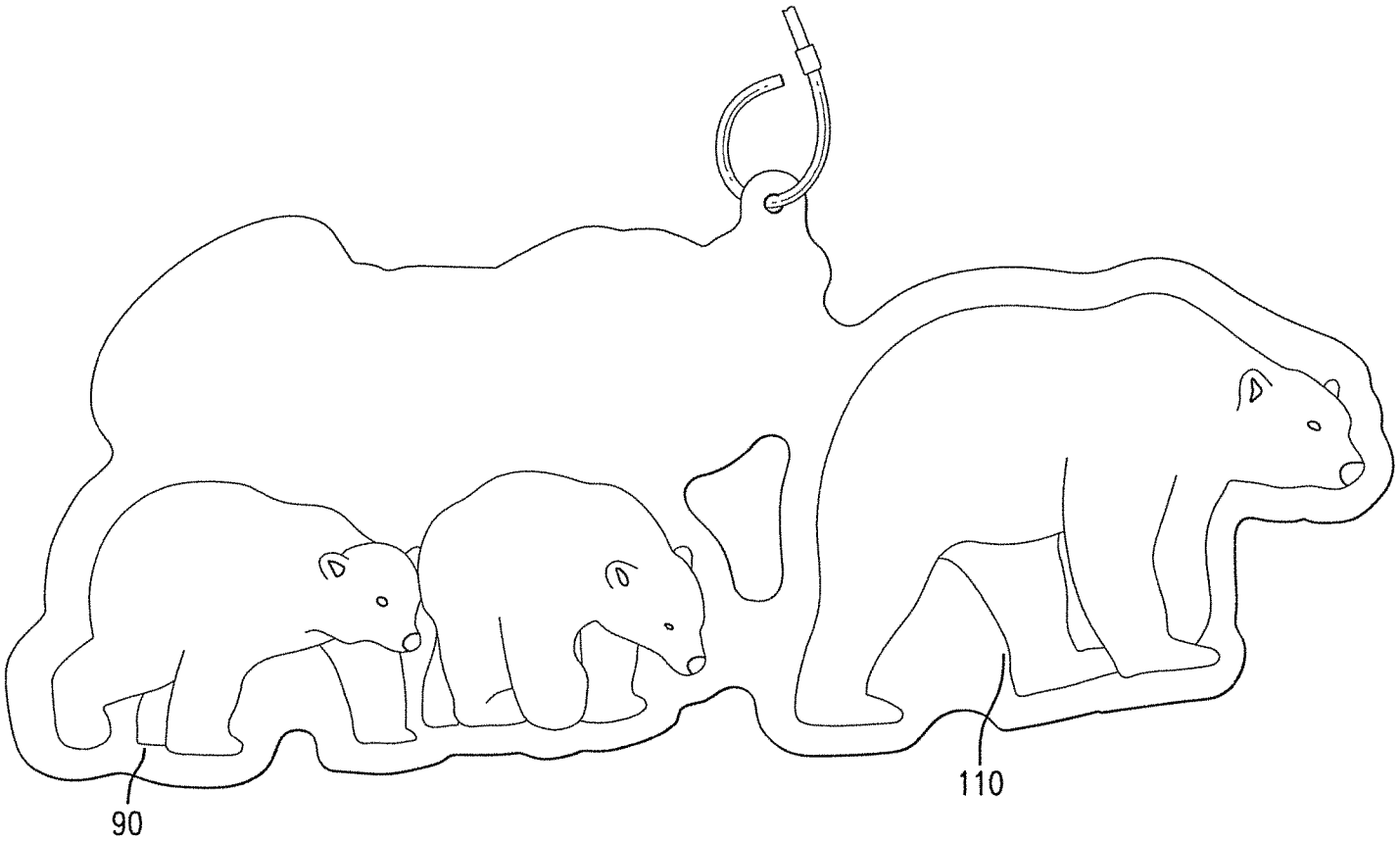
FIG. 7 is a front view of an ornament removed from the package shown in FIG. 6.
Figure 8:
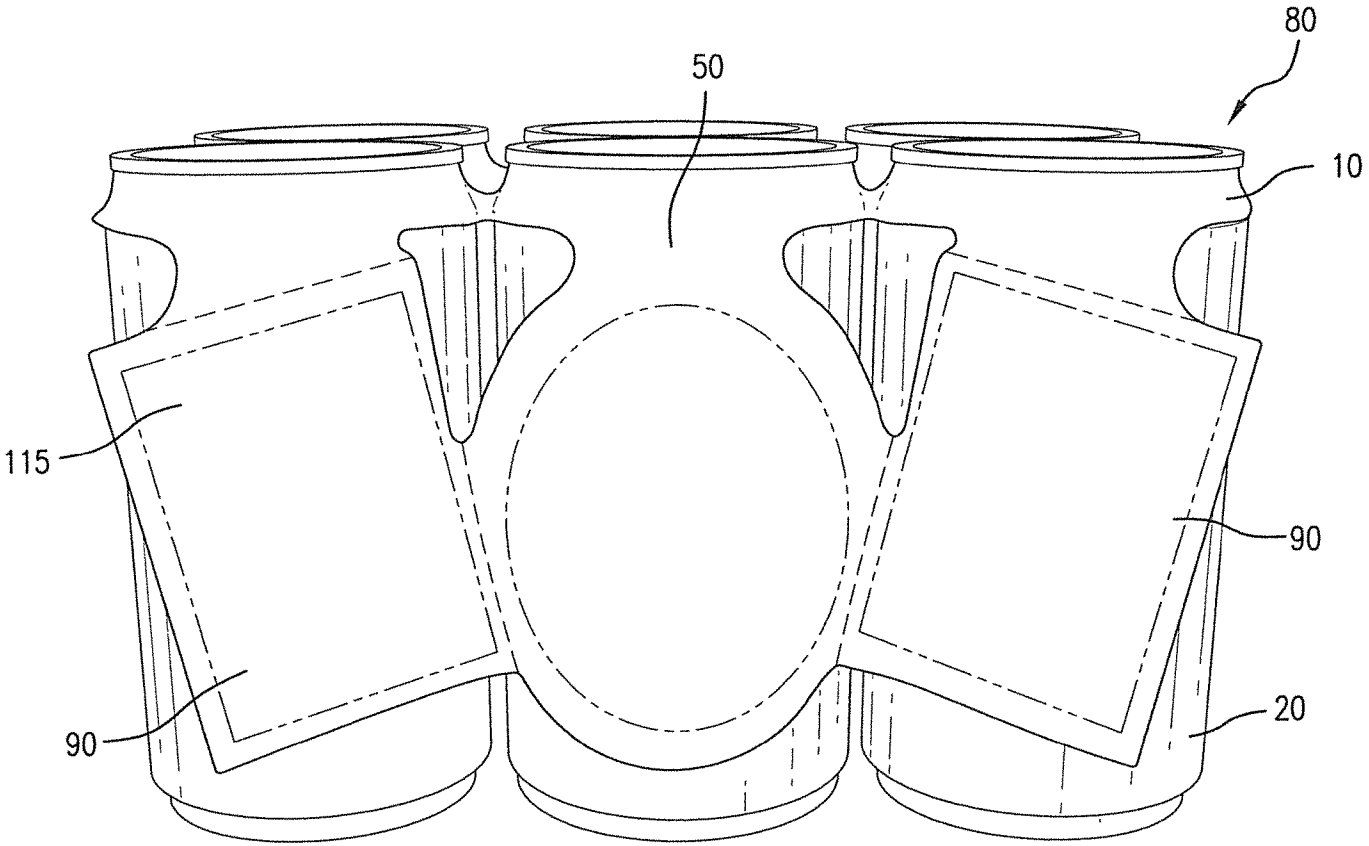
FIG. 8 is a front view of a package of containers according to one preferred embodiment of this invention.

Panel 50 is preferably integrally formed with the sheet 15 so that the panel 50 extends outward from a longitudinal edge of the sheet 15. Panel 50 is preferably shaped to convey at least one of a product name, a product property, a promotional shape, a trademark, a tradename, alpha-numeric characters, symbols and/or a fanciful design intended to draw attention to the product. In addition, panel 50 is configured to include a "value-added" giveaway 90 such as a wristband 100 as shown in FIGS. 1 and 2 or a bookmark 105 as shown in FIGS. 3-5, or an ornament 110 as shown in FIGS. 6 and 7; or trading cards 115 as shown in FIG. 8.

According to a preferred embodiment of this invention, the giveaway 90 is separated from the remainder of the panel 50 and/or sheet 15 by a line of weakness 60 such as a perforation or similar cut or series of cuts placed into the sheet 15 to permit removal of the giveaway 90 from the remainder of the package 80. Alternatively, the giveaway 90 may be separated from the remainder of the package 80 using a knife or scissors or similar instrument and may include instructions and/or visual indications of where and/or how to do so.

As shown in FIG. 1, a pair of wristbands 100 are positioned alternatingly across the panel 50 and removable along line of weakness 60. The wristbands may be formed with locking tabs and corresponding adjustment apertures to facilitate placement on the wrist following removal from the carrier 10 or package 80. Similarly, FIGS. 3 and 4 show a bookmark 105 positioned within the panel 50 that is removable along a line of weakness and reusable as a placemark in a book. FIGS. 6 and 7 show an ornament 110 that is removable from the package and separately displayable. Likewise, FIG. 8 shows a pair of trading cards 115 that are removable from the package 80. Other giveaways 90 may be positioned in such removable fashion relative to the package 80 including decorative objects, novelty items like eye patches or false teeth or any other similar generally planar object that may be formed from the plastic sheet 15 and removably attached relative to the remainder of the package 80.

In a preferred embodiment of this invention, not shown in the drawings, the carrier 10 may further comprise an integral handle positioned between rows of container receiving apertures 25 or along an opposite longitudinal edge of sheet 15. The handle may be particularly important in configurations of the carrier 10 that contain many container receiving apertures 25 to facilitate ease of handling of package 80. Alternatively, or in addition, the handle may be likewise configured to convey at least one of a product name, a product property, a promotional shape, a trademark, a tradename, alpha-numeric characters, symbols and/or a fanciful design intended to draw attention to the product. Both the handle and the panel 50 may include corresponding die cuts, either identical or complementary including the product name, the product property, the promotional shape, the trademark, the tradename, the alpha-numeric characters, symbols and/or the fanciful design. Likewise, the handle may be configured to include an integrated giveaway 90 for removal from the remainder of the package 80, either along a line of weakness 60 or with instructions and/or visual indications for removal.

Still further, the handle may be integrally formed with the panel 50 and be likewise configured to convey at least one of a product name, a product property, a promotional shape, a trademark, a tradename, alpha-numeric characters, symbols and/or a fanciful design intended to draw attention to the product. Likewise, such integrated handle and panel may be configured as a giveaway for removal and reuse by a consumer.

As shown in FIGS. 2 and 5, containers 20 are preferably positioned in each container receiving aperture 25 to form the package 80. The panel 50 is preferably generally flat and parallel with respect to containers 20 and prominent with respect to package 80. If the panel 50 is curled or folded in a perpendicular position with respect to package 80, then the giveaway 90, advertising or other material positioned on panel will not be legible to a consumer. In addition, a panel 50 that protrudes with respect to the package 80 will create difficulties in packaging, handling and stacking packages 80 because of interference between panels 50 of adjacent packages 80 and between panel 50 and packaging equipment.

According to additional preferred embodiments, such as shown in FIGS. 9-12, a carrier 101 for carrying a plurality of containers may include planar sheet 135 having a plurality of container receiving apertures 125 arranged in longitudinal rows and transverse ranks. At least one panel 150 is integrally formed with the sheet and die cut to form at least two sub-elements 160 that are removable and assembled into a decorative or functional giveaway for reuse.

The carrier 101 according to this preferred embodiment includes at least two sub-elements 160 that are separated within the panel 150 by one or more lines of weakness 170. Lines of weakness 170 are preferably formed by one or more perforations extending at least partially through the panel 150.

Figure 9:
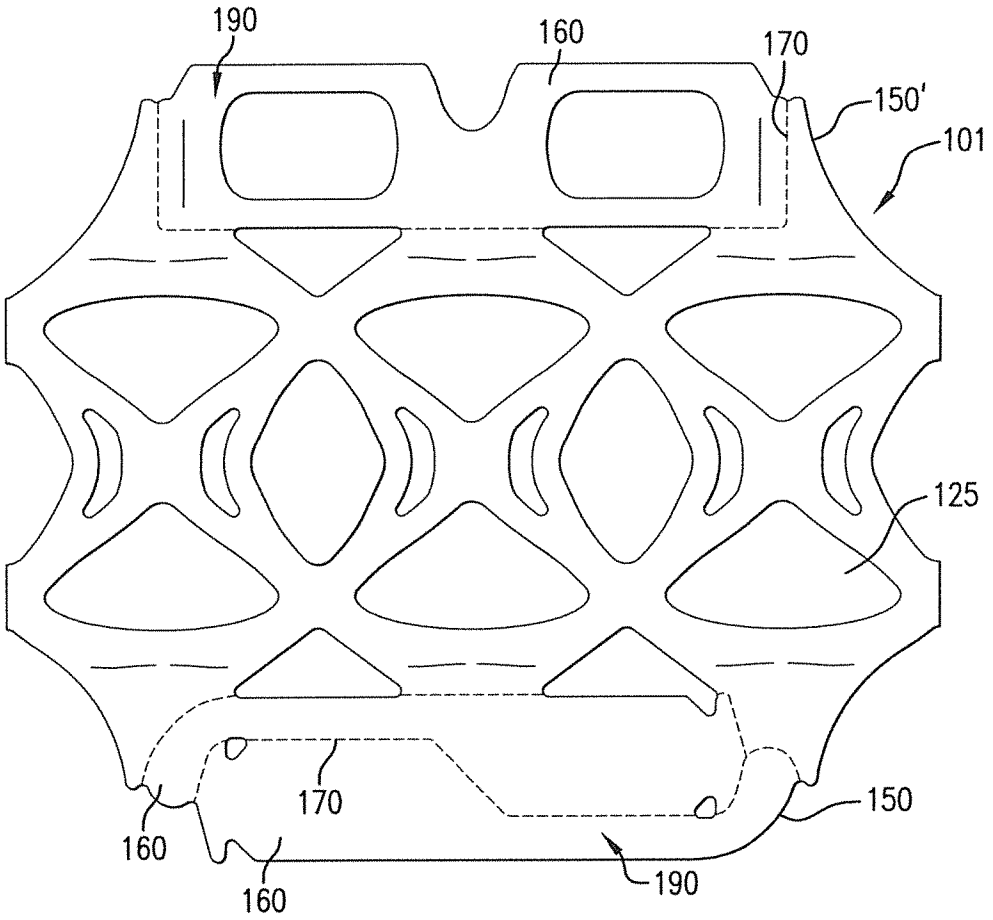
FIG. 9 is a side elevational view of a flexible carrier according to one preferred embodiment of this invention.
Figure 10:
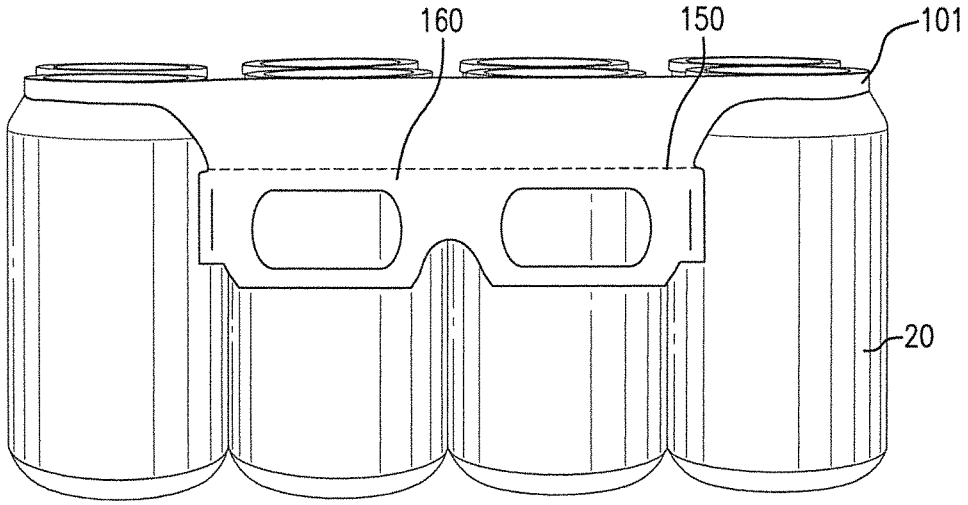
FIG. 10 is a front view of a package of containers using the carrier shown in FIG. 9.

FIGS. 9 and 10 show one preferred embodiment wherein the giveaway 190 comprises a pair of glasses. The glasses may comprise novelty, non-functional glasses or may comprise utilitarian glasses such as 3-D glasses for enjoyment of movies or fireworks. The carrier 110 shown in FIGS. 9 and 10 preferably comprises two panels 150, 150', each panel 150, 150' positioned on an opposite side of the carrier 101. According to one embodiment, at least one of the at least two sub-elements 160 are positioned within each of the two panels 150, 150'. In particular, the carrier 101 of comprises glasses that are assembled from at least three sub-elements 160 including a frame and two temples.

Figure 11:
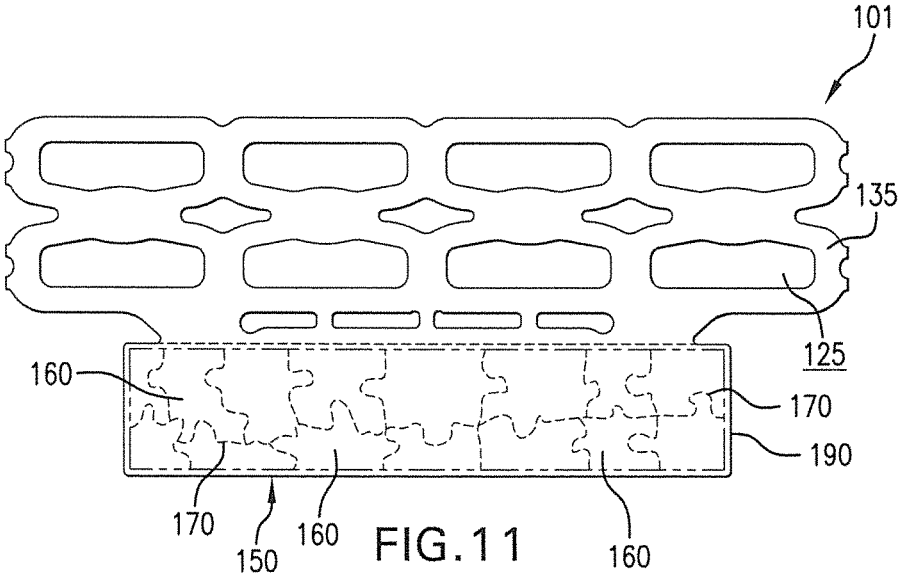
FIG. 11 is a side elevational view of a flexible carrier according to one preferred embodiment of this invention.

FIG. 11 shows one preferred embodiment wherein the giveaway 190 comprises a puzzle. The carrier 101 shown in FIG. 11 preferably includes a plurality of sub-elements 160 that may be assembled to form a puzzle. The carrier 101 shown in FIG. 11 may comprise two panels 150, 150' wherein each panel 150, 150' includes a separate plurality of sub-elements 160 or pieces that together form a unitary puzzle.

Figure 12:
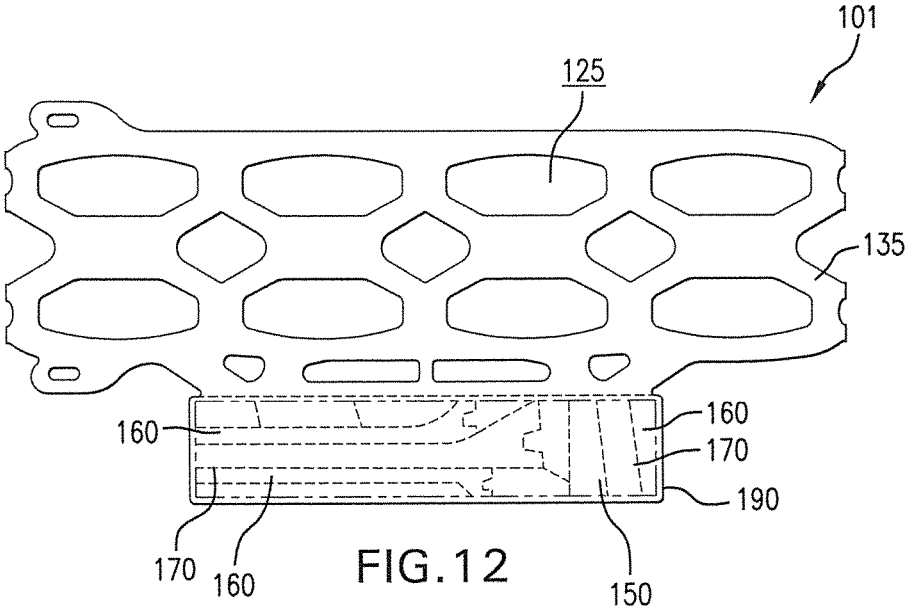
FIG. 12 is a side elevational view of a flexible carrier according to one preferred embodiment of this invention.

FIG. 12 shows one preferred embodiment wherein the giveaway 190 comprises a model. The carrier 101 shown in FIG. 12 preferably includes a plurality of sub-elements 160 that may be assembled to form a model, such as a miniature building, animal, vehicle, product or other object. Specifically, as shown in FIG. 12, the model may comprise, for example, a representation of the Eiffel Tower. The carrier 101 shown in FIG. 12 may comprise two panels 150, 150' wherein each panel 150, 150' includes a separate plurality of sub-elements 160 or pieces that together form a unitary model.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. A carrier for carrying a plurality of containers, the carrier comprising:

a planar sheet of a plastic material, the sheet having a plurality of container receiving apertures arranged in longitudinal rows and transverse ranks;

at least one panel integrally formed with the sheet, the at least one panel extending outward from an edge of the sheet, the at least one panel die cut to form at least two sub-elements that are removable and assembled by connecting the at least two sub-elements into a decorative or functional giveaway for reuse.

2. The carrier of claim 1 wherein the giveaway comprises at least one of glasses, an ornament, a model, and a puzzle.

3. The carrier of claim 1 wherein the carrier comprises two panels, each panel positioned on an opposite side of the carrier.

4. The carrier of claim 3 wherein at least one of the at least two sub-elements are positioned within each of the two panels.

5. The carrier of claim 1 wherein the giveaway comprises glasses that are assembled from at least three sub-elements including a frame and two temples.

6. The carrier of claim 1 wherein the at least two sub-elements are separated by a line of weakness.

7. The carrier of claim 1 further comprising a plurality of sub-elements assembled to form a puzzle.

8. The carrier of claim 1 further comprising a plurality of sub-elements assembled to form a model.

9. A package including a carrier unitizing a plurality of containers, the package comprising:

a planar sheet of a plastic material, the sheet having a plurality of container receiving apertures arranged in longitudinal rows and transverse ranks, each container receiving aperture engaged with a container of the plurality;

a panel integrally formed with the sheet, the panel extending along the plurality of container receiving apertures, the panel die cut to form two or more removable sub-elements assembled by connecting the two or more removable sub-elements into a decorative or functional giveaway.

10. The package of claim 9 wherein the giveaway comprises at least one of glasses, an ornament, a model, and a puzzle.

11. The package of claim 9 wherein the carrier comprises two panels, each panel positioned on an opposite side of the carrier.

12. The package of claim 11 wherein at least one of the two or more removable sub-elements are positioned within each of the two panels.

13. The package of claim 9 wherein the giveaway comprises glasses that are assembled from at least three sub-elements including a frame and two temples.

14. The package of claim 9 wherein the two or more sub-elements are separated by perforations.

* * * * *